United States Patent [19]

Demidowicz et al.

[11] 4,202,536

[45] May 13, 1980

[54] AUTOMATED INSTALLATION FOR PUNCHING AND CLEANING OF CONVERTER TUYERES

[75] Inventors: Lech Demidowicz, Maja; Mieczyslaw Sztuka, Jagiellonska, both of Poland

[73] Assignee: Kombinat Gorniczo-Hutniczy Miedzihuta Miedzi "Legnica", Legnica, Poland

[21] Appl. No.: 912,297

[22] Filed: Jun. 5, 1978

[30] Foreign Application Priority Data

Jun. 7, 1977 [PL] Poland ..... 198745

[51] Int. Cl.[2] ..... F27D 23/02

[52] U.S. Cl. ..... 266/135; 173/122; 266/271

[58] Field of Search ..... 266/135, 136, 265, 269, 266/271, 272, 273; 173/122

[56] References Cited

U.S. PATENT DOCUMENTS

| | | | |
|---|---|---|---|
| 1,219,963 | 3/1917 | Lefebvre | 266/136 |
| 2,432,996 | 12/1947 | Larson et al. | 266/136 |
| 3,314,671 | 4/1967 | Heino et al. | 266/271 |
| 3,328,016 | 6/1967 | Foard et al. | 266/136 |
| 3,667,748 | 6/1972 | Dienenthal et al. | 266/271 |
| 4,114,865 | 9/1978 | McKerrow et al. | 266/269 |

FOREIGN PATENT DOCUMENTS

| | | |
|---|---|---|
| 90615 | 3/1975 | Poland . |
| 632602 | 11/1949 | United Kingdom . |

*Primary Examiner*—L. Dewayne Rutledge
*Assistant Examiner*—John P. Sheehan
*Attorney, Agent, or Firm*—Haseltine, Lake & Waters

[57] ABSTRACT

An automated installation for punching and cleaning converter tuyeres for use in non-ferrous pyrometallurgy. The invention employs a travel unit fixed either to the converter housing permits movement of the punching unit relative to the tuyeres and, consequently, piercing of tuyeres at the converter. The unit consists of a punching rod slidable along the axis for introducing the punching end-piece of the punching rod into the tuyeres and a car securing the opposite end of the punching rod. The car resting on the rail is moved along by a driving unit. The drive mechanism of the travel unit has at least one power cylinder located transversally with respect to the rail, whereas on the extended end of the piston rod of this cylinder is a carriage with at least one pair of pull rods is mounted being coupled with the rod in an articulated way.

Still another embodiment of the invention consists in an application of only one pair of pull rods mounted on the both sides of the piston rod of the above mentioned cylinder in an articulated way slidable in a carriage in a plane perpendicular to the axis of the above mentioned power cylinder. One of pull rods is connected in an articulated way with the rail on the side of the above mentioned power cylinder opposite to the punching unit, while the other pull rod with is connected with the punching unit accommodating the working tool.

12 Claims, 8 Drawing Figures

AUTOMATED INSTALLATION FOR PUNCHING AND CLEANING OF CONVERTER TUYERES

BACKGROUND OF INVENTION

The present invention relates to an automated installation for punching and cleaning nozzles of converters used in non-ferrous metallurgy.

In the present state of the art there are numerous designs of these installations. The most similar to the presented invention being in U.S. Pat. No. 1,219,963, relating to an installation for punching converter tuyeres directed to maintaining them in operating condition for ensuring free passage. The installation consists of two combined cylinders, whereas the piston rod of the top cylinder drives the cross rod with the heads accommodating the punching rod for every second tuyere mounted thereon and the piston rod of the bottom cylinder drives the punching rod for the remaining tuyeres. The described installation is suited to a simultaneous punching of half a number of tuyeres being built in one converter during one working cycle. The remaining tuyeres are punched during the next working cycle of the machine.

The above mentioned design makes use of:

(a) a small working speed of the punching rod within the punching zone and the required use of a cylinder of very great power in order to obtain the forces necessary for a simultaneous piercing of all tuyeres; and (b) a considerable length of the punching unit rendering impossible this to be used in contemporary converters.

Furthermore, the above mentioned installation is suited to converters with a vertical layout which are no longer used in contemporary non-ferrous metallurgy.

In an installation according to the British Patent No. 632,602 there have been used one to three punching units moving along the converter tuyeres, each of them consisting of two cylinders, whereas the bottom cylinder drives the top cylinder mounted on suitable springs having a piston rod provided with a punching rod situated at the end of the rod. The punching units are moved along a separate unit by means of a line power cylinder and pull rods on suitable rails, whereas the driving system used enables alignment of the punching unit with the individual tuyeres and punching of the tuyeres. The punching units either move along the long stationary rails of the converter or the rails themselves are moved along a circular track with respect to the converter, thus rendering possible the converter tuyeres to be pierced at various converter positions.

The design mentioned and described above has the following features:

(a) the top cylinder with its piston rod having a large bearing surface passes through a ball closure of the tuyere head and in this very place the piston rod bearing surface often becomes damaged and, consequently, the top cylinder becomes loose and is unserviceable after a short time of operation;

(b) the punching rod being an extension of the piston rod is rigidly connected with this piston rod. In practice, the tuyeres are not built in one line and the introduction of the piercing rod requires an appropriate positioning of the top cylinder mounted on suitable springs in order to enable the necessary displacement of the cylinder. This design is disadvantageous since a rapid introduction of the piercing pin into the tuyere is accompanied with a rapid resetting of the cylinder; considerable weight of the cylinder and the large forces of inertia causing rapid displacement, produces destructive bending forces as well as an accelerated abrasive action;

(c) the unit for moving the punching unit along a circular track requires ample free space and makes difficult access to the tuyeres necessary for maintenance.

Installation according to the Polish Patent No. 90,615 consists of a set of several cylinders combined in series, wherein the individual feeds and speeds are added algebraically. The set of cylinders moves on guideways rendering it possible to align the piercing unit with the individual tuyeres. The punching rod connected with the extreme piston rod of the cylinder is introduced into the tuyere. The whole installation is either fastened to the converter or may move on a separate unit over a circular track, thus rendering it possible for the tuyeres to be pierced at various positions of converter.

The operation of the installation is completely automated and does not require additional manipulations. The design discussed herein above employs a punching unit of considerable length thus rendering it impossible for the application of the unit to converters built too close the bearing structure of the converter house.

The automated installation for punching and cleaning of converter tuyeres according to the present invention is fitted with a travel unit (car) fastened either to the converter housing or to a separate unit rendering it possible to displace the punching unit with respect to the tuyeres and, consequently, allowing the punching operation to take place at a stationary or revolved converter.

The punching unit is provided with suitable working tools either in the form of a punching rod slidable along the axis of the tuyeres or a slidable rotary drill mounted in the supporting guide introducing the punching end of the punching rod or drill into the tuyere. The opposite end of the punching rod or drill is secured in a car mounted on the rail and moved along it by means of the driving unit.

SUMMARY OF INVENTION

According to the invention, the punching unit has a driving unit imparting the reciprocating motion to a working tool provided with at least one line power cylinder located transversely to the rail axis for imparting the reciprocating motion along a cylinder axis to a carriage mounted at the end of the cylinder. The carriage is coupled on one side to the rail of the punching unit and on the other side with a car of the punching unit. The sliding motion of the carriage imparts the reciprocating motion of appropriate speed and piercing force to a working tool. The application of pull rods of a variable length enables the reciprocating motion to be suited to the tuyeres of various lengths and ensures the required acceleration of the motion in the last zone of the tuyeres blocked by hardened metal.

Pull rods of variable length are formed with power cylinders energized in a controlled fashion e.g., with compressed air. The punching unit is moved by a travel unit along the row of tuyeres. After positioning the punching unit in the axis of chosen tuyere, a transversely set power cylinder is actuated and the motion of the driving unit on the rail along the axis in the direction of the tuyere takes place with simultaneous additional displacement of the car of the punching unit with the working tool mounted therein.

In the extreme position of the punching unit, the punching rod has considerable speed and striking force and it removes metal deposits built-up in the tuyeres by exerting an appropriate force on it. Simultaneously, in this position of the punching rod, all cylinders act in the reverse direction and quickly withdraw the punching rod from the tuyere and particularly from the punching zone. The withdrawal of the punching rod unit to the initial position is extremely smooth due to the action of an additional braking system.

It is the object of the present invention to overcome the defects of the prior art.

Another object of the present invention is to provide a speedy and efficient apparatus for removal of metal deposits in tuyeres.

Other objects and advantages of the present invention will be better understood with respect to the claims, specification and drawings as described herein.

IN THE DRAWINGS

FIG. 1 presents the driving unit with pull rods having constant length with immovable pull rod fixing points in the carriage.

FIG. 2 is the same unit with pull rods having a movable fixing point in the carriage.

FIG. 3 presents the side view of the installation in the initial position.

FIG. 4 is the side view of the same installation in the operating position of the working tool.

FIG. 5 presents the view in section 5—5 shown in FIG. 3 along the line power cylinder.

PREFERRED EMBODIMENTS OF INVENTION

The installation according to the invention has two embodiments.

Figure 1:
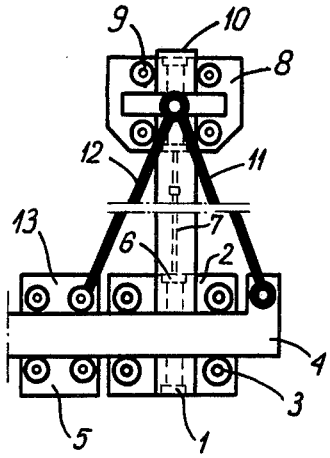

In the first more simple embodiment, shown in FIG. 1, the driving unit 1 travelling on a car 2 with the wheel set 3 along the rail 4 of a punching unit 5 having a power cylinder 6 located transversely relative to the axis of the rail 4. The cylinder being provided with carriage 8 mounted on the opposite end of its piston rod 7 moved by means of the wheel set 9 along a travel beam 10. In the above mentioned carriage, there are mounted two articulated pull rods 11 and 12. One of these pull rods 11 is fixed at one end in an articulated way to rail 4 of the piercing unit 5 and the second pull rod 12 is also fixed in an articulated way to car 13 of the punching unit 5.

In this embodiment, car 13 of the punching unit 5 moves linearly along the rail 4 towards the converter due to the action of the carriage 8 attracted by power cylinder 6 towards the car 2 of the driving unit 1. The linear motion being the result of the action of the motion of only carriage 8.

Figure 2:
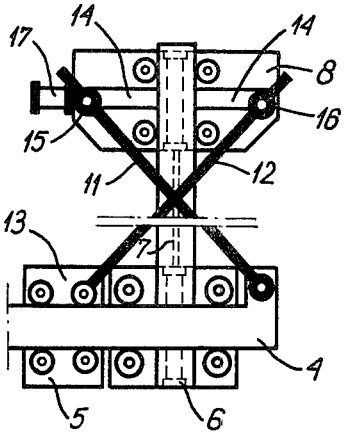

In the next embodiment shown in FIG. 2, pull rods 11 and 12 are also fixed to carriage 8 in an articulated way, but they can be shifted in a plane perpendicular to the axis of the piston rod 7 of power cylinder 6 along guides 14 located in carriage 8. Variation of the fixing points 15, 16 of pull rods 11 and 12 in carriage 8 is effected by the line power cylinder 17 fastened to the same carriage.

In this embodiment, the motion of the car 13 of the piercing unit 5 is the result of superposition of the motion of carriage 8 and the displacement of the fixing points 15 and 16 of pull rods 11 and 12 in this carriage towards the axis of piston rod 7 of power cylinder 6. The displacement of the fixing points 15 and 16 of pull rods 11 and 12 can be effected either for both the pull rods simultaneously or for one pull rod only.

Figure 3:
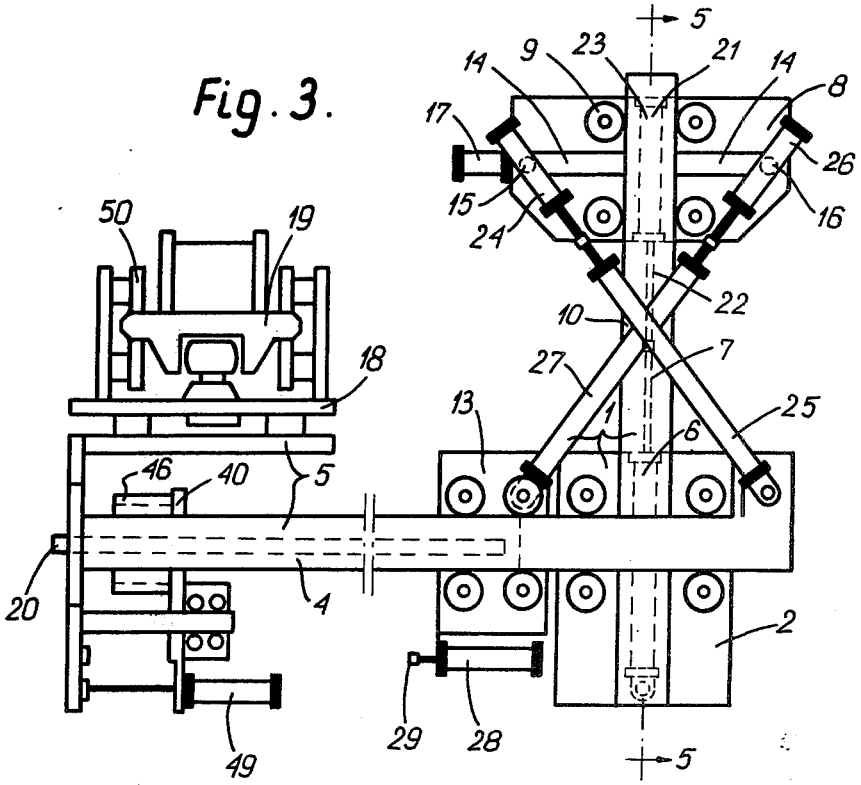
Figure 4:
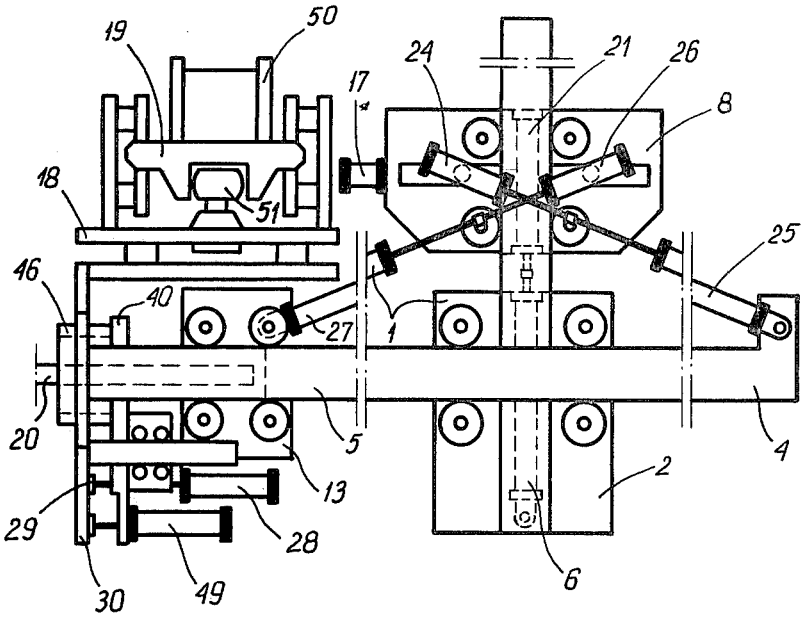
Figure 5:
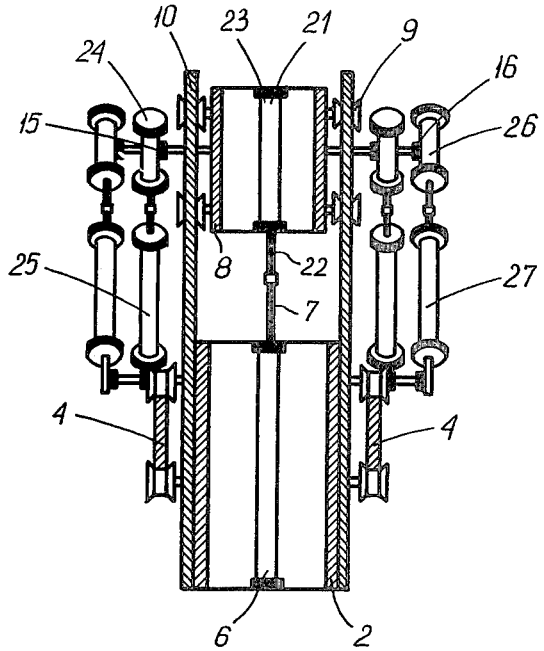

In FIGS. 3 and 4, an example of embodiment of installation is presented wherein all advantages of the invention have been fully utilized.

In this embodiment, the punching unit 5 is mounted in a removable way to the travel unit 18 moving on the travel system 19. The piercing unit being provided with rail 4 along which car 13 of the punching unit 5 moves with the working tool in the shape of a punching rod 20 mounted in it, as well as car 2 of the driving unit 1. In this car there is mounted transversely to the axis of rail 4 power cylinder 6 and an additional upper power cylinder 21, both cylinders being coaxial with each other and connected by means of piston rods 7 and 22. The cylinder 23 of the additional upper actuating mechanism 21 has mounted thereon the carriage 8 moved on the wheel set 9 along the travel beam 10 fastened in car 2 of the driving unit 1.

Pull rods of the driving unit 1 are made in the form of dynamic pull rods of variable length these being the line power cylinders coupled coaxially in pairs. The first pair form power cylinders 24 and 25, which serve as the pull rod 11 connecting the carriage 8 with the rail 4, the second pair form power cylinders 26 and 27, which serve as the pull rod 12, connecting carriage 8 with the car 13 of the punching unit 5. The upper power cylinders 24 and 26 of each pair are mounted in an articulated way in carriage 8 at their fixing points 15 and 16 and may be shifted in this carriage in a plane perpendicular to the axis of piston rods 7 and 22. The displacement of the fixing points 15 and 16 of these power cylinders 24 and 26 in guides 14 is effected by the line power cylinder 17 mounted on carriage 8.

As a result of energizing of the installation for punching the converter tuyeres, automatically, by means of a special control system (not shown in the figures), the punching unit is set in such a position that its punching rod 20 is set in the axis of the converter tuyeres and is positioned by the punching rod 5 exactly in the axis of the respective tuyeres. As soon as the punching rod is aligned with the respective tuyere, the driving unit 1 is actuated and, in consequence, the punching unit 5 begins to move towards the converter.

The arrangement of the individual elements of the both units, that is the driving unit 1 and piercing unit 5 in the working position of the piercing rod 20 has been shown in FIG. 4.

As a result of the action of power cylinders 6, 25 and 27 carriage 8 begins to move towards the car 2 of the driving unit 1, thus causing simultaneous motion of the both cars; that is, car 2 of the driving unit 1 and car 13 of the punching unit 5 along the rail 4 towards the converter. In the subsequent stage, all the remaining power cylinders 21, 24, 26 and 17 become actuated, thus causing a violent acceleration of the car 13 of the punching unit 5 towards the converter. At the moment of punching of the converter tuyere, the individual elements of the punching unit 5 are nearest to the converter which has been shown in FIG. 4. The withdrawal of the punching rod 20 is effected by reversing the direction of energizing the power cylinders of the driving unit 1 by a special automatic control system (not shown in the figure) thus causing a simultaneous reversed action of all power cylinders.

In order to improve the dependability of the unit at the moment of withdrawal of the punching rod 20 from the punching zone, an additional line power cylinder 28 has been applied, this being fastened to car 13 of the punching unit 5, being actuated automatically after receiving a proper signal from automatic control system, repulsed by the piston rod 29 from the plate of punching unit 5.

Figure 6:
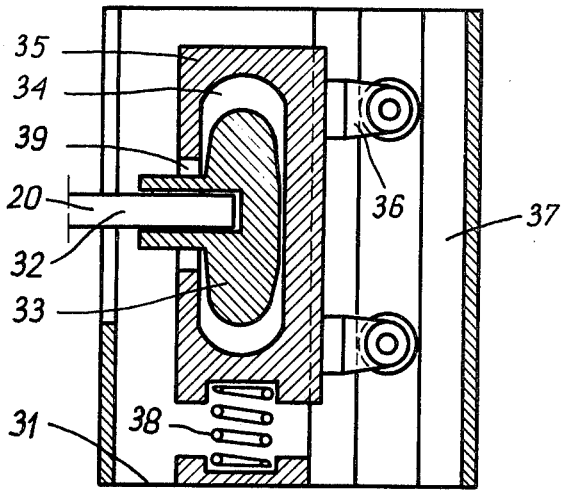
FIG. 6 is a cut-away view of the working tool clamping grip.

In order to ensure an elastic introduction of the punching rod 20 to the tuyere, a special clamping grip 31 has been designed; an exemplary embodiment of this grip is shown in FIG. 6.

The end 32 of the punching rod 20 opposite to the converter tuyere is mounted in mushroom head 33 positioned in the seat 34 in body 35. The body is mounted in an anti-friction manner in guide 37 by means of suitable grips 36 rendering possible the motion of the body 35 in the vertical plane. Body 35 is supported on an elastic element in the form of a spring 38. Due to additional loosening in the mounting of head 33 in seat 34 and in the hole 39, and due to the vertical motion of the body 35, the punching rod 20 can be freely introduced into the converter tuyere.

The clamping grip 31 is made in the form of a drawer-like punching unit 5 replacable and removable from car 13.

Punching rod 20 is mounted loosely and is removable from head 33; and it is protected against being pulled out by means of a known dowelled joint (not shown in the figure).

The application of a clamping grip 31 in the form of a replacable unit renders it possible for the punching rod to be replaced by another working tool e.g., a drill mounted in a drilling machine fixed in a chuck having the dimensions and external shape corresponding to the clamping grip 31.

Figure 7:
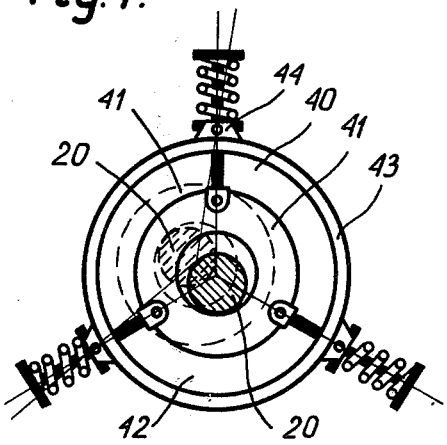
FIG. 7 illustrates the displacement of the punching rod in a plane relative to the axis of the guide.

Still another sub-assembly rendering possible and elastic introduction of the punching rod 20 into the converter tuyere is a special guide 40 designed according to the invention. It has a shape of a ring 41 suspended elastically in recess 42 of body 43 by means of grips 44 mounted in an articulated way in body 43 in the plane of the ring 41. In case of a non-axial positioning of punching rod 20 relative to the conical entrance zone of the tuyere body, the rod is introduced into the tuyere axis thanks to this conical entrance zone of the tuyere opening. The above mentioned displacement of the punching rod 20 is rendered possible by the guide 40 accommodating the punching rod 20. The displacement of the punching rod 20 together with ring 41 in its plane relative to the axis of body 43 of guide 40 has been shown in FIG. 7 by means of dashed line.

Figure 8:
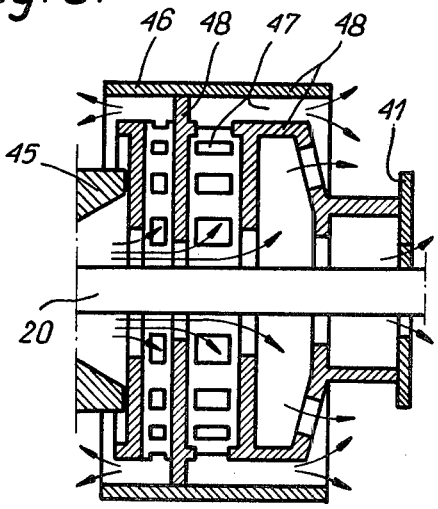
FIG. 8 illustrates the side view of the damping sleeve.

In order to reduce noise produced by compressed air outflowing from the tuyere 45 at the moment of introduction of the punching rod 20 into the tuyeres a special damping unit shown in FIG. 8 has been designed. It consists of at least two sleeves provided with perforations 47 over the circumference and special partition walls 48, situated inside and outside the sleeve. The partitions together with perforations 47 form a labyrinth reducing the velocity of air outflowing from the tuyere 45 (the path of air has been shown by means of arrows in FIG. 8). The damping unit 46 is mounted to ring 41 of guide 40 on the side of the tuyere 45 and fixed to this element.

Both units, that is guide 40 and damping unit 46, are advanced to the tuyere together with the punching rod 20 moving in the tuyere 45 by means of an additional power cylinder 4 (vide FIG. 4).

The travel unit 18 (vide FIGS. 3 and 4) is moved along the travel structure 19 on a wheel set 50. Thrust roller 51 serves for taking the punching force imparted by the striking punch rod 20 at the moment of punching the blocked tuyere 45.

The travel sub-assembly 19 of the travel unit 18 may be either mounted to the converter or fixed to a separate bearing structure, not connected with the converter.

The embodiments according to the invention presented above are suitable for converters where punching of tuyeres is required and is particularly applicable in converters of the PEIRCE SMITH and HOBOKEN type.

The design according to the invention is featured with small overall dimensions. Owing to this, it can be built in converters with a limited space available for maintenance of the tuyere and renders possible an economic design of the converter bay.

An automated installation according to the invention cooperating with the converter performs automatic operations connected with punching and cleaning of tuyeres, eliminates manual servicing operations, raises the average intensity of air blown to the tuyeres and enables a remote automatic control of the equipment.

What we claim is:

1. An automated apparatus for punching and cleaning the converter tuyeres to be used particularly in non-ferrous pyrometallurgy, said apparatus being provided with a travel unit mounted to a converter housing enabling displacement of a punching unit with respect to the tuyeres and punching of the tuyeres at converter means, said punching unit employing an axially shiftable punching rod mounted in a supporting guide for introducing the working end of the rod into the tuyeres, the opposite end of the punching rod mounted, being in a car, said car being mounted on a rail and being movable along said rail by means of a driving unit, said driving unit including: at least one power cylinder situated transversely relative to the axis of the rail, provided with a piston rod and on the extended end of said piston rod there being mounted a carriage, upon which at least one pair of pull rods is mounted, one of these pull rods being coupled in an articulated fashion with the rail on the side of the above mentioned power cylinder opposite to said punching unit, and the other pull rod being coupled with the car of the punching unit, wherein the punching rod is mounted.

2. An automated assembly for punching and cleaning of converter tuyeres for use primarily in non-ferrous pyrometallurgy provided with travel means fixed to a converter housing or the like, said travel unit rendering possible a displacement of the said punching assembly with respect to the tuyeres and punching of said tuyeres at a converter means, said punching assembly containing an axially slidable punching rod mounted in a supporting guide for introducing the end of the rod into the tuyere, the opposite end of this punching rod being fastened to a car, said car resting on a rail and moved along said rail by means of a driving unit, a driving mechanism of the punching assembly being provided with at least one power cylinder situated transversely with respect to the axis of the rail, whereby on the extended end of the piston rod of the power cylinder there being mounted a carriage, wherein on the both sides relative to the axis of the piston rod of the above mentioned power cylinder there being mounted at least one pair of pull rods adapted to move in an articulated way, said pull rods being slidable in said carriage in a plane perpendicular to the axis of the above mentioned power cylinder, and one of the pull rods being connected in an articulated way with a rail on the side of the above mentioned power cylinder opposite to the punching assembly and the second pull rod being coupled with a car of the punching assembly wherein said punching rod being mounted.

3. An assembly as claimed in claim 1 wherein: said pair of pull rods being of a variable length and are preferably in the shape of line power cylinders with at least one cylinder.

4. An assembly as claimed in claim 1 wherein: said pair of pull rods are of a constant length.

5. An assembly as claimed in claim 1, wherein: said working rod is mounted in the car of the punching assembly by means of the clamping grip, the non-punching end of the punching rod is freely positioned in a plane perpendicular to its axis with limited freedom of movement restricted by the clamping grip, said clamping grip being mounted in the car and being removable from the car for replacement by another element.

6. An assembly as claimed in claim 1, wherein: the punching end of the punching rod being disposed inside the guide and the punching end of the working rod being mounted in an elastic and slidable way in a plane transverse with respect to the axis of said guide; said guide being a solid non-divided ring, jointly suspended on pins and jointly mounted in guide grips and between the opposite ends of pins and the grip of the body where the springs are mounted.

7. An assembly as claimed in claim 1, wherein: the punching end of the working tool being disposed inside the damping unit, said damping unit having the form of at least one sleeve with perforations and partitions thereby forming together a labyrinth for directing the air outflowing from the tuyere.

8. An assembly as claimed in claim 2 wherein: said pair of pull rods being of variable length and are preferably in the shape of line power cylinders with at least one cylinder.

9. An assembly as claimed in claim 2 wherein: said pair of pull rods are of a constant length.

10. An assembly as claimed in claim 2, wherein: said working rod is mounted in the car of the punching assembly, by means of a clamping grip; the non-punching end of the punching rod is freely positioned in a plane perpendicular to its axis, with the limited freedom of movement restricted by the clamping grip, said clamping grip being mounted in the car and being removable from the car and replaced by another element.

11. An assembly as claimed in claim 2, wherein: the punching end of the punching rod being situated inside the guide and said end of the punching rod being mounted in an elastic and slidable way in a plane transverse with respect to the axis of said guide; said guide being of a solid non-divided ring jointly suspended on pins which are jointly mounted in the guide grips and said springs being mounted between the opposite ends of the pins and the grip of the body.

12. An assembly as claimed in claim 2 wherein: the punching end of the working tool is situated inside the damping unit, said damping unit having the form of at least one sleeve with perforations and partitions together forming a labyrinth for directing the air outflowing from the tuyeres.

* * * * *